US006042160A

United States Patent [19]

Hamada et al.

[11] Patent Number: 6,042,160

[45] Date of Patent: Mar. 28, 2000

[54] LATCH DEVICE FOR VEHICLE BACK DOOR

[75] Inventors: Yoshikazu Hamada; Yuji Yoda, both of Yamanashi-ken, Japan

[73] Assignee: Mitsui Kinzoku Kogyo Kabushiki Kaisha, Tokyo, Japan

[21] Appl. No.: 08/916,405

[22] Filed: Aug. 22, 1997

[30] Foreign Application Priority Data

Aug. 23, 1996 [JP] Japan ..... 8-239963
Aug. 27, 1996 [JP] Japan ..... 8-244251

[51] Int. Cl.[7] ..... E05C 3/06

[52] U.S. Cl. ..... 292/216; 292/337; 292/340; 292/DIG. 41; 70/142

[58] Field of Search ..... 292/1, 337, DIG. 41, 292/DIG. 53, DIG. 55, DIG. 40, DIG. 43, 346, 341.12, 340, 216; 70/13, 142, DIG. 32; 411/399, 533; 403/408.1, 277

[56] References Cited

U.S. PATENT DOCUMENTS

| | | | |
|---|---|---|---|
| 1,473,076 | 11/1923 | Bonilla . | |
| 3,761,119 | 9/1973 | Bennett | 292/346 |
| 3,997,202 | 12/1976 | Tack | 292/216 |
| 4,097,078 | 6/1978 | Tack et al. . | |
| 4,237,709 | 12/1980 | Krugener | 70/107 |
| 4,838,588 | 6/1989 | Hayakawa et al. . | |
| 4,896,907 | 1/1990 | Hayakawa et al. . | |
| 4,898,414 | 2/1990 | Yamada | 292/337 |
| 5,054,826 | 10/1991 | Dow | 292/125 |
| 5,172,946 | 12/1992 | Dowling | 292/216 |
| 5,348,357 | 9/1994 | Konchau | 292/216 |
| 5,364,138 | 11/1994 | Dietrich | 292/1.5 |
| 5,445,326 | 8/1995 | Ferro et al. . | |
| 5,458,382 | 10/1995 | Boadwine | 292/337 |
| 5,547,239 | 8/1996 | Allenbaugh | 292/346 |

*Primary Examiner*—B. Dayoan
*Assistant Examiner*—Gary Estremsky
*Attorney, Agent, or Firm*—Browdy and Neimark

[57] ABSTRACT

A vehicle back door latch device has a striker fixed to a vehicle body, and a latch assembly fixed to a vehicle back door. The latch assembly comprises a main metal plate having a vessel-shaped storing portion for storing a latch, a sub metal plate fixed to the main metal plate so as to cover an upper opening of the storing portion. The storing portion is defined by a bottom wall, a front wall, a rear wall, a right-hand wall and a left-hand wall. A main notch portion and a sub notch portion are respectively formed in the bottom wall and the front wall for receiving the striker when the back door is closed. The rear wall is formed into an arc shape swelling backward. Engaging portions are respectively formed on both sides of the sub notch portion of the front wall, and studs which are engaged with the engaging portions when the back door is closed are fixed to the striker. A convex portion is formed in the main metal plate and a concave portion which is engageable with the convex portion is formed in the sub metal plate.

6 Claims, 5 Drawing Sheets

FIG. 1
(PRIOR ART)
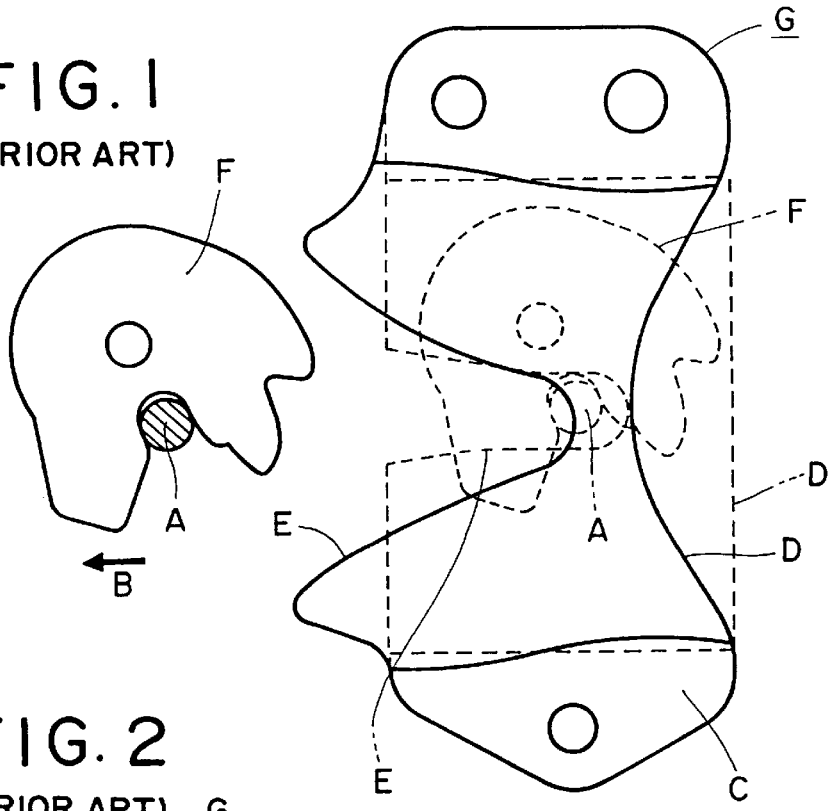
FIG. 2
(PRIOR ART)
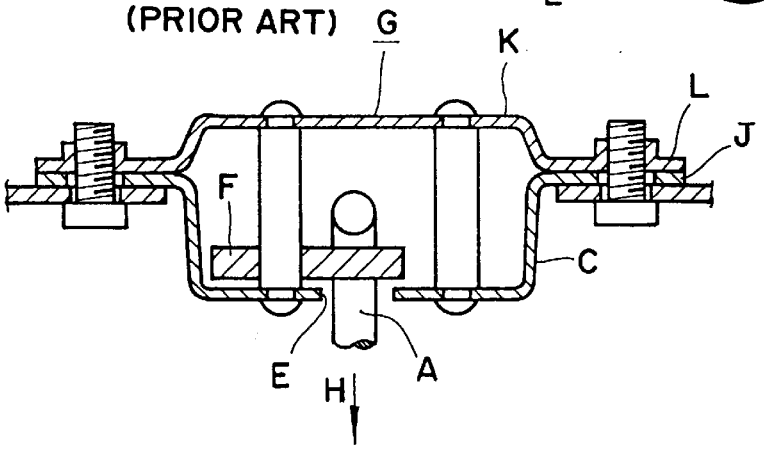
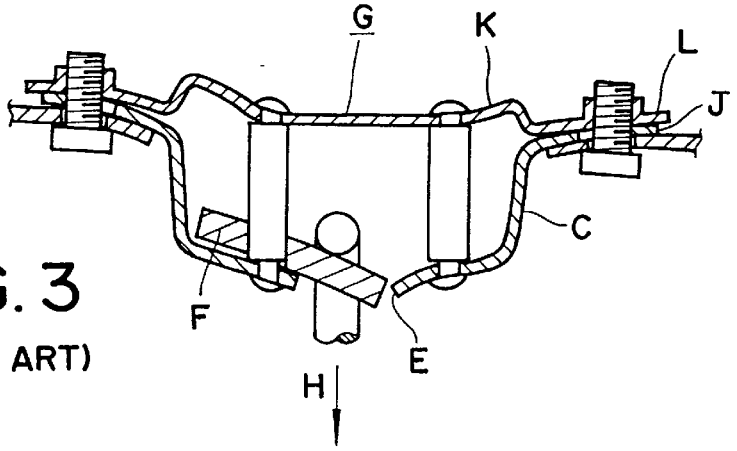
FIG. 3
(PRIOR ART)

FIG. 4
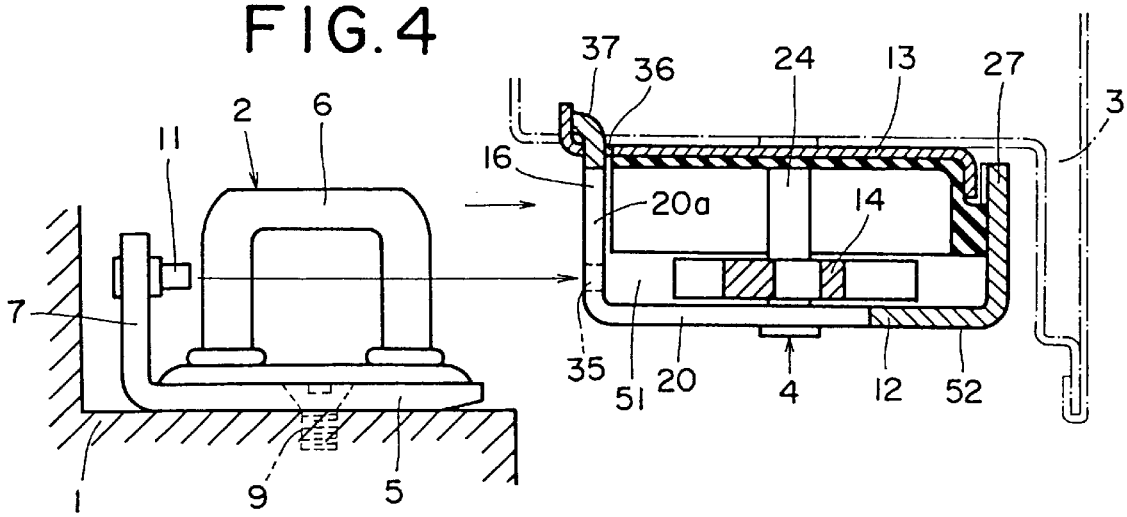
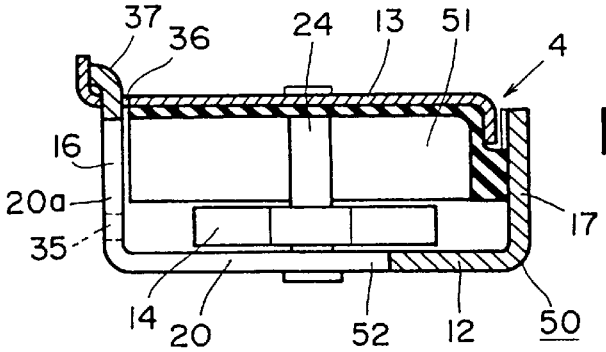
FIG. 8
FIG. 9
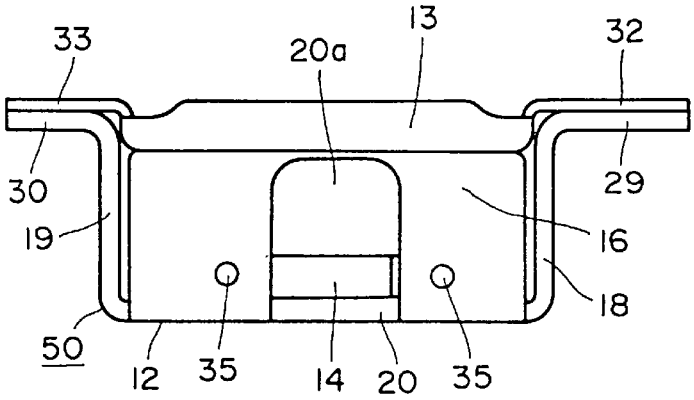

LATCH DEVICE FOR VEHICLE BACK DOOR

FIELD OF THE INVENTION

The present invention relates to a latch device for a vehicle back door and particularly relates to a latch device for improving strength and rigidity of a housing thereof.

PRIOR ART

A housing of a latch device used in a vehicle back door is conventionally constructed by a main metal plate and a sub metal plate fixed to the main plate. A spatial portion for storing a latch which is engageable with a striker and a ratchet which is engageable with the latch for holding the engagement of the latch with the striker is provided within the housing. The main plate is formed by press drawing working into a vessel shape having upright front and rear walls, upright right-hand and left-hand walls, and a bottom wall. The sub plate is attached to the main plate so as to cover an upper opening of the vessel to define the spatial portion of the housing. A main notch portion and a sub notch portion for receiving the striker when the back door is closed are respectively formed in the bottom wall and the front wall. The strength of the housing thus formed substantially depends on strengths of the two metal plates.

FIG. 1 shows results obtained by tentatively giving a large load to the conventional latch device. As can be clearly seen from FIG. 1, when a striker A is pulled by a large load in the direction of an arrow B, a rear wall D of the main plate C which is originally flat as shown by a phantom line is greatly curved as shown by a solid line and a main notch portion E of the main plate C is greatly opened so that a latch F can be disengaged from a housing G. This problem can be overcome by arranging a reinforcing member within the housing as in a latch device of a vehicle swinging door. However, it is not realistic to add the reinforcing member to the latch device for the back door since the back door latch device must be manufactured at low cost.

FIGS. 2 and 3 show results of applying a large load to the striker A in a different direction. When the load is applied to the striker A in the direction of an arrow H, the main plate C is strongly pulled downward. As a result, a shift is caused between an attaching portion J of the main plate C and an attaching portion L of the sub plate K. It has become clear that this shift further promotes deformation of the main plate C.

SUMMARY OF THE INVENTION

Accordingly, an object of the present invention is to provide a back door latch device for improving the strength of a rear wall of a main plate.

Another object of the present invention is to provide a latch device for preventing a notch portion formed in the main plate from being opened by external force.

Another object of the present invention is to provide a latch device in which no shift is easily caused between an attaching portion of the main plate and an attaching portion of a sub plate.

BRIEF DESCRIPTION OF THE DRAWINGS

FIG. 1 shows a plan view of the results of a strength test of a conventional back door latch device when a force in a direction B is applied to the latch.

FIG. 2 shows a sectional view through the latch of FIG. 1.

FIG. 3 shows the results of a strength test on the latch of FIG. 2 when a force in a direction H is applied to the latch.

FIG. 4 is a view showing a latch assembly according to the invention attached to a vehicle back door and a striker fixed to a vehicle body.

FIG. 8 is a longitudinal sectional view of the latch assembly of FIG. 4.

FIG. 9 is a front view of the latch assembly of FIG. 4.

DESCRIPTION OF THE PREFERRED EMBODIMENT

Figure 5:
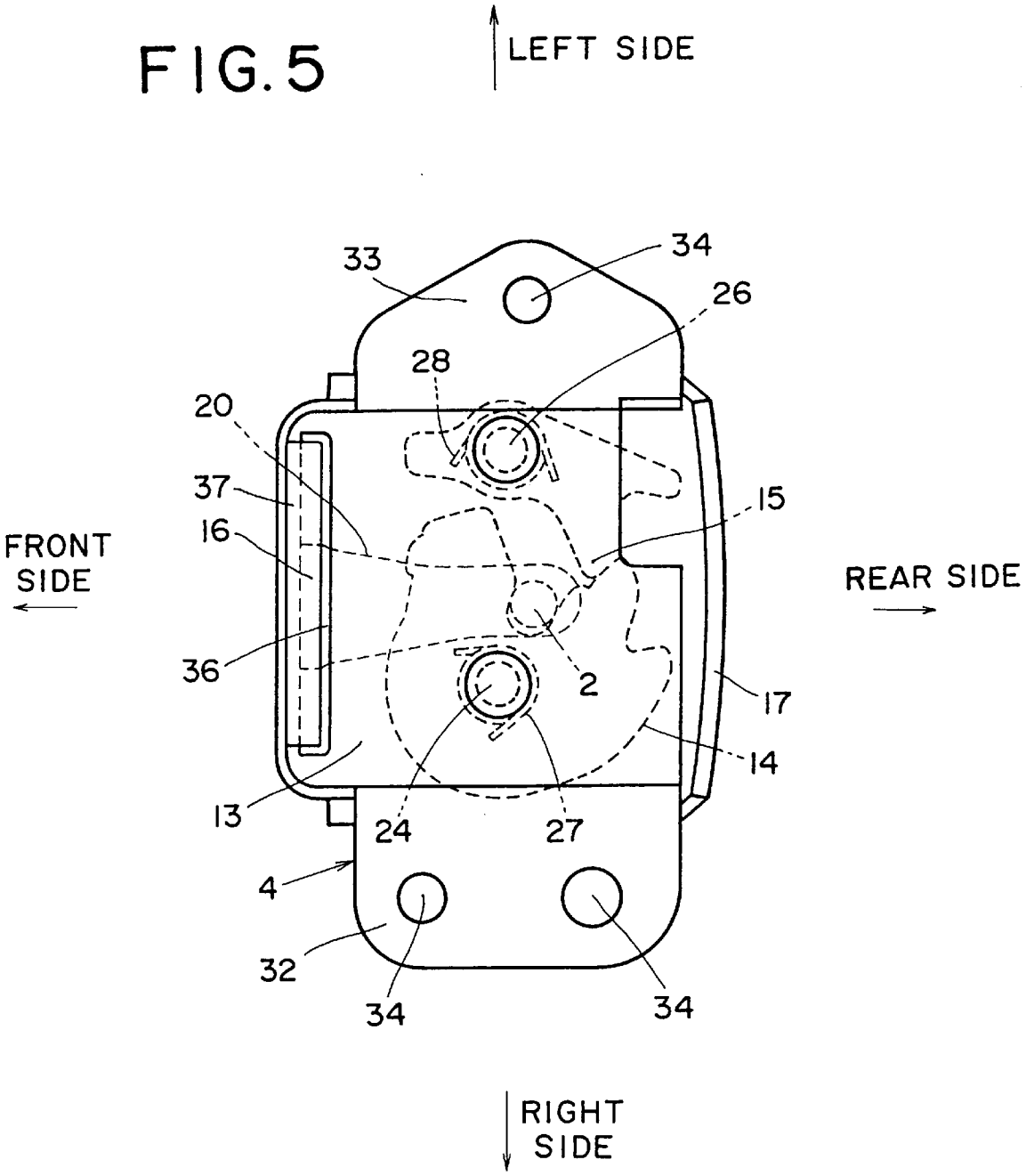
FIG. 5 is a plan view of the latch assembly of FIG. 4.

As shown in FIG. 4, a latch device of the present invention has a latch assembly 4 fixed to a back door or a trunk lid 3 of a vehicle and a striker 2 fixed to a vehicle body 1. A housing 50 of the latch assembly 4 is constructed by a substantially vessel-shaped main metal plate 12 and a metal sub plate 13 fixed to an upper portion of the main plate 12 so as to cover an upper opening of the main plate 12. A spatial portion 51 for storing a latch 14 which is engageable with the striker 2 and a ratchet 15 which is engageable with the latch 14 so as to hold the engagement of the latch 14 with the striker 2, is arranged within the housing 50. There is a case in which the latch assembly 4 is attached to the vehicle body 1. In this case, the striker 2 is naturally fixed to the back door 3.

The latch 14 and the ratchet 15 are rotatably attached to the housing 50 by shafts 24 and 26, respectively. In FIG. 5, the latch 14 is biased by the resilient force of a spring 27 in a counterclockwise direction, and the ratchet 15 is biased by the resilient force of a spring 28 in a clockwise direction.

The main plate 12 is formed by press drawing working into a vessel shape having an upright front wall 16, an upright rear wall 17, an upright right-hand wall 18, an upright left-hand wall 19, and a bottom wall 52. A main notch portion 20 and a sub notch portion **20*a* for receiving the striker 2 when the back door 3 is closed, are respectively formed in the bottom wall 52 and the front wall 16**.

A short hook 37 at an upper portion of the front wall 16 is angled to extend forward and is engaged with a slit 36 formed in the sub plate 13.

Figure 6:
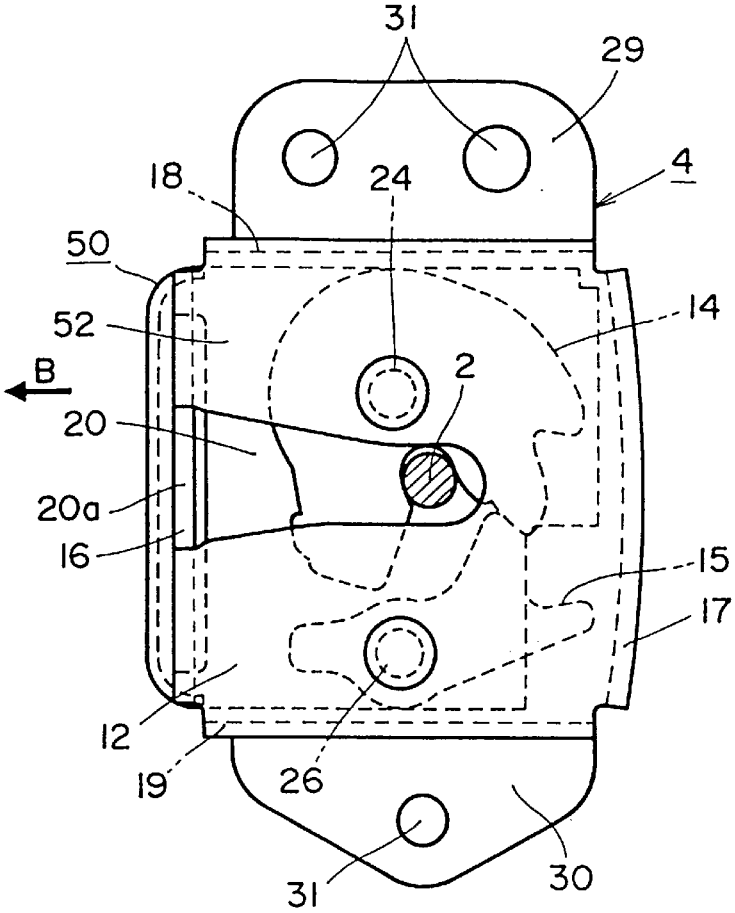
FIG. 6 is a bottom view of the latch assembly of FIG 4.
Figure 7:
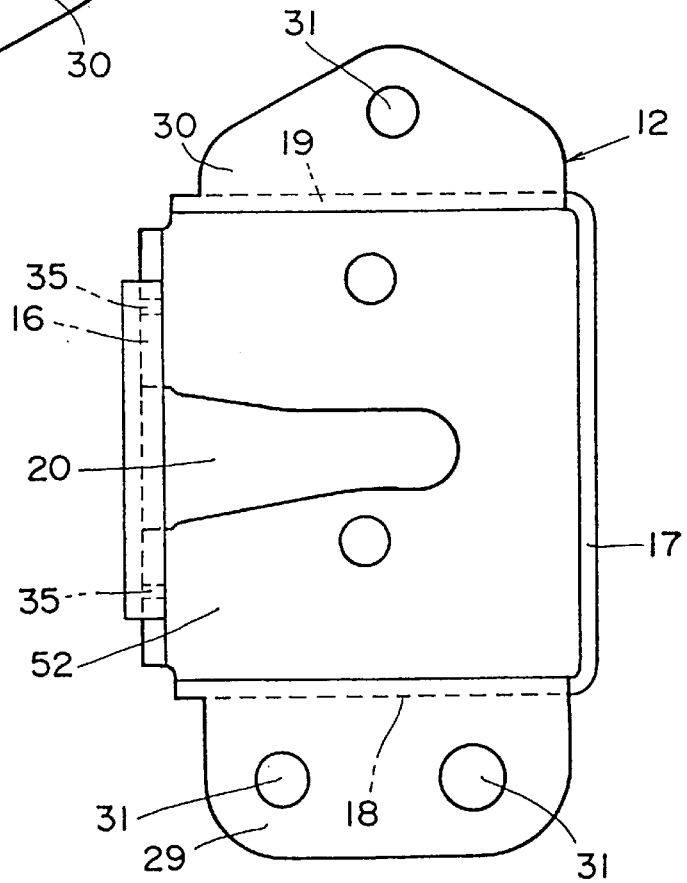
FIG. 7 is a plan view of a main metal plate of FIG. 4.

As clearly shown in FIGS. 5 and 6, the upright rear wall 17 is not formed in the shape of a flat wall, but is formed in the shape of an arc wall swelling backward. Therefore, great forward deformation of the rear wall 17 is prevented even when a strong external force is applied to the striker 2 forward, i.e., in the direction of an arrow B.

The main plate 12 has a main right-hand attaching portion 29 which is angled to extend horizontally from an upper portion of the upright right-hand wall 18, and a main left-hand attaching portion 30 which is angled to extend horizontally from an upper portion of the upright left-hand wall 19. The sub plate 13 has a sub right-hand attaching portion 32 corresponding to the right-hand attaching portion 29 and a sub left-hand attaching portion 33 corresponding to the left-hand attaching portion 30. The right-hand attaching portions 29, 32 and the left-hand attaching portions 30, 33 are fixed to the back door 3 by using bolts 53 and nuts 54 (see FIG. 12).

Figure 12:
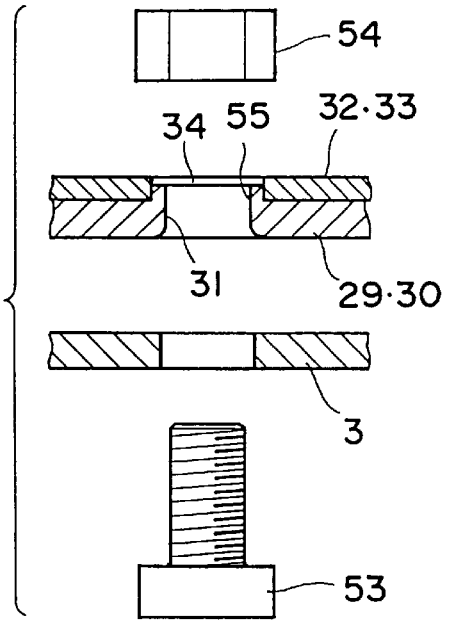
FIG. 12 is an enlarged sectional view of a main attaching portion and a sub attaching portion of FIG. 9.
Figure 13:
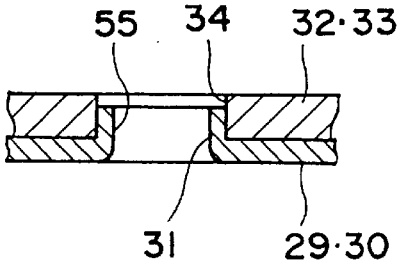
FIG. 13 is a view showing a modified example of FIG. 12.

Holes 31 through which the bolts 53 are inserted are formed in the main attaching portions 29 and 30, holes 34 through which the bolts 53 are inserted are formed in the sub attaching portions 32, 33. As shown in FIG. 12, a diameter of each of the holes 31 is set to be slightly smaller than that of each of the holes 34. Each of the holes 31 has a ring-shaped flange 55 integrally formed with the main attaching portions 29, 30 which is inserted into a corresponding one of the holes 34. A length of the flange 55 is set to be shorter than thickness of the sub attaching portions 32, 33. The engagements between the ring-shaped flanges 55 and the holes 34 prevent generation of the shift explained with reference to FIGS. 2 and 3. FIG. 13 shows a modified example in which the flange 55 extends into each of the holes 34 of the sub attaching portions 32, 33. In the example of FIG. 13, the use of a nut can be omitted by forming a screw groove in each of the flange 55 and a hole 34.

Figure 10:
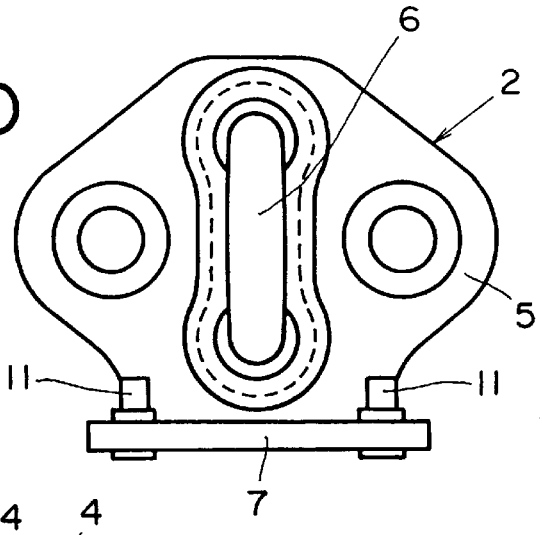
FIG. 10 is a plan view of the striker of FIG. 4.
Figure 11:
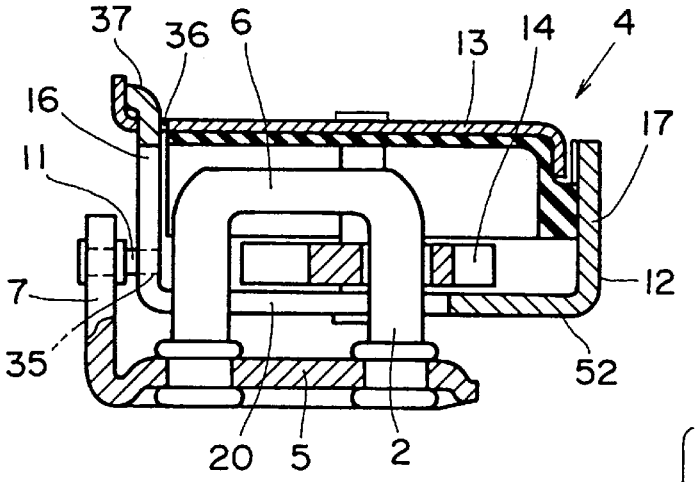
FIG. 11 is a cross-sectional view showing a state in which the latch is engaged with the striker of FIG. 4.

As shown in FIGS. 4, 10 and 11, the striker 2 has a metal base plate 5 fixed to the vehicle body 1 by a screw or bolt 9, and a substantially U-shaped rod 6 fixed to the base plate 5. A bent wall 7 is formed in an end portion of the base plate 5 and angled to substantially extend in parallel to the front wall 16. The bent wall 7 does not come in contact with the front wall 16 even when the back door 3 is closed. At least two metal studs 11 projecting toward the front wall 16 are fixed to the bent wall 7. Concave portions or holes 35 for respectively receiving the studs 11 when the back door 3 is closed are formed on both sides of the sub notch portion 20*a* of the front wall 16. When the studs 11 are respectively engaged with the holes 35 by closing the back door, it is very difficult to widen the front wall 16 leftward and rightward with the sub notch portion 20*a* as a center. Thus, the bottom wall 52 is prevented from widening leftward and rightward with the main notch portion 20 as a center.

The foregoing discussion discloses and describes merely exemplary embodiment of the present invention only. One skilled in the art will readily recognize from such discussion, and from the accompanying drawings and claims, that various changes, modifications and variations can be made therein without departing from the spirit and scope of the invention as defined in the following claims.

What is claimed is:

1. A vehicle back door latch device having a striker fixed to one of a vehicle body and a vehicle back door, and a latch assembly fixed to the other of the vehicle body and the vehicle back door, said latch assembly comprising;

a latch engaged with the striker for holding a closed state of the back door when closed;

a main metal plate having a vessel-shaped storing portion for storing the latch, said storing portion being defined by a bottom wall, a front wall, a rear wall, a right-hand wall and a left-hand wall;

a sub metal plate fixed to the main metal plate so that an upper opening of the storing portion is covered by the sub metal plate;

a main notch portion formed in the bottom wall for receiving the striker when the back door is closed;

a sub notch portion formed in the front wall for receiving the striker when the back door is closed; and first engaging means located on both sides of the sub notch portion of the front wall and second engaging means located on said striker for preventing separation of said front wall adjacent to said sub notch portion and said bottom wall adjacent to said main notch portion when said back door is closed and said latch device is, impacted by a force.

2. The latch device according to claim 1 wherein said first engaging means comprises engaging recesses respectively located on both sides of said sub notch and said second engaging means comprises corresponding studs on said striker.

3. The latch device according to claim 2 wherein said striker has a base plate fixed to the vehicle body or the back door, a rod fixed to the base plate and engageable with the latch, and a bent wall fixed to the base plate which is substantially parallel to the front wall; wherein said studs are fixed to the bent wall.

4. The latch device according to claim 2, wherein said studs extend toward the front wall.

5. The latch device according to claim 2, wherein said main metal plate has a main attaching portion and said sub metal plate has a sub attaching portion;

said main attaching portion having at least one first hole, said first hole having a flange formed around a circumference of said first hole;

said sub attaching portion having at lest one second hole;

said flange being engaged in said second hole when a screw or a bolt is engaged through said first hole and said second hole to fix said main attaching portion and said sub attaching portion to the vehicle body.

6. The latch device according to claim 2, wherein said second hole has a diameter slightly larger than that of said first hole.

* * * * *